US008544531B2

(12) United States Patent
Scott et al.

(10) Patent No.: US 8,544,531 B2
(45) Date of Patent: Oct. 1, 2013

(54) SURFACE COOLER WITH NOISE REDUCTION

(75) Inventors: David Russell Scott, Walsall (GB); Berwyn Owain Pollard, Wolverhampton (GB)

(73) Assignee: HS Marston Aerospace Ltd. (GB)

( * ) Notice: Subject to any disclaimer, the term of this patent is extended or adjusted under 35 U.S.C. 154(b) by 721 days.

(21) Appl. No.: 12/813,941

(22) Filed: Jun. 11, 2010

(65) Prior Publication Data

US 2011/0303398 A1 Dec. 15, 2011

(51) Int. Cl.
*F28F 13/00* (2006.01)
*F28D 7/02* (2006.01)

(52) U.S. Cl.
USPC ..... 165/135; 181/292

(58) Field of Classification Search
USPC ..... 165/135, 164, 51; 181/292, 294, 181/284, 288
See application file for complete search history.

(56) References Cited

U.S. PATENT DOCUMENTS

| | | | | |
|---|---|---|---|---|
| 2,512,875 | A * | 6/1950 | Reynolds | 392/435 |
| 2,809,813 | A * | 10/1957 | Fletcher | 165/51 |
| 3,235,001 | A * | 2/1966 | Giannotti | 165/51 |
| 3,797,561 | A * | 3/1974 | Clark et al. | 60/39.08 |
| 3,837,395 | A | 9/1974 | Coolidge | |
| 4,266,602 | A * | 5/1981 | White et al. | 165/124 |
| 4,621,677 | A * | 11/1986 | Suzuki et al. | 165/135 |
| 5,189,929 | A | 3/1993 | Chory | |
| 5,445,861 | A | 8/1995 | Newton et al. | |
| 5,655,361 | A * | 8/1997 | Kishi | 60/266 |
| 5,709,263 | A | 1/1998 | Mira | |
| 6,058,696 | A | 5/2000 | Nikkanen et al. | |
| 6,106,229 | A | 8/2000 | Nikkanen et al. | |
| 6,973,790 | B2 | 12/2005 | Suenaga et al. | |
| 7,311,175 | B2 | 12/2007 | Proscia et al. | |
| 7,401,682 | B2 | 7/2008 | Proscia et al. | |
| 7,578,369 | B2 | 8/2009 | Francisco et al. | |
| 2008/0096451 | A1 | 4/2008 | Haerle | |
| 2008/0264616 | A1 | 10/2008 | Deschodt et al. | |
| 2009/0317238 | A1 | 12/2009 | Wood et al. | |
| 2010/0065366 | A1 | 3/2010 | Soltau et al. | |
| 2010/0139900 | A1 | 6/2010 | Thompson | |
| 2011/0126544 | A1 | 6/2011 | Foster | |

FOREIGN PATENT DOCUMENTS

| | | |
|---|---|---|
| DE | 1167557 A | 10/1969 |
| EP | 2206893 A2 | 7/2010 |

OTHER PUBLICATIONS

Combined Examination and Search Report No. GB1109642.7 dated Sep. 28, 2011.
Combined Search and Examination Report for GB Application No. 1109643.5, dated Sep. 30, 2011, pp. 1-5.

* cited by examiner

*Primary Examiner* — Tho V Duong
(74) *Attorney, Agent, or Firm* — Cantor Colburn LLP

(57) ABSTRACT

A surface cooler is provided and includes an oil layer through which oil flows, fins extending into an air flow pathway and being disposed at a first side of the oil layer in heat transfer communication with the oil, an acoustic lining to reduce noise present in or transmitted by the air flow pathway, which is disposed at a second side of the oil layer opposite the first side and noise transfer tubes extending through the oil layer to transfer the noise present in or transmitted by the air flow pathway to the acoustic lining.

20 Claims, 3 Drawing Sheets

SURFACE COOLER WITH NOISE REDUCTION

BACKGROUND OF THE INVENTION

The subject matter disclosed herein relates to a surface cooler and, more particularly, to a surface cooler with noise reduction.

Typically, a surface cooler is installed in a wall of an aero engine turbofan bypass duct. Normally, the surface cooler is used to cool engine oil but can be used for cooling other fluids. This oil travels through an oil layer and secondary surface fins directly above the oil layer protrude into airflow moving through the bypass duct. The heat transfer between the airflow and the secondary surface fins leads to heat removal from the hot oil through a flat primary surface separating plate to which the secondary surface fins are connected and the secondary surface fins.

The bypass duct of an aero engine is usually lined with an acoustic lining. This acoustic lining reduces the noise caused by the fan and, therefore, reduces overall engine noise. Due to the common location of the surface cooler and the acoustic lining, however, in order to enable installation of each, a section of the acoustic lining needs to be removed. Hence, engine noise levels will tend to increase.

BRIEF DESCRIPTION OF THE INVENTION

According to one aspect of the invention, a surface cooler is provided and includes an oil layer through which oil flows, fins extending into an air flow pathway and being disposed at a first side of the oil layer in heat transfer communication with the oil, an acoustic lining to reduce noise present in or transmitted by the air flow pathway, which is disposed at a second side of the oil layer opposite the first side and noise transfer tubes extending through the oil layer to transfer the noise present in or transmitted by the air flow pathway to the acoustic lining.

According to another aspect of the invention, a surface cooler is provided and includes first and second separating plates formed to define through-holes and disposed at respective first and second opposing sides of an oil layer through which oil flows, fins extending into an air flow pathway and coupled to the first separating plate at a distance from the first separating plate through-holes, an acoustic lining coupled to the second separating plate and being formed with a plurality of cells formed about the second separating plate through-holes and noise transfer tubes extending through the oil layer in fluid communication with the through-holes of the first and second separating plates.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
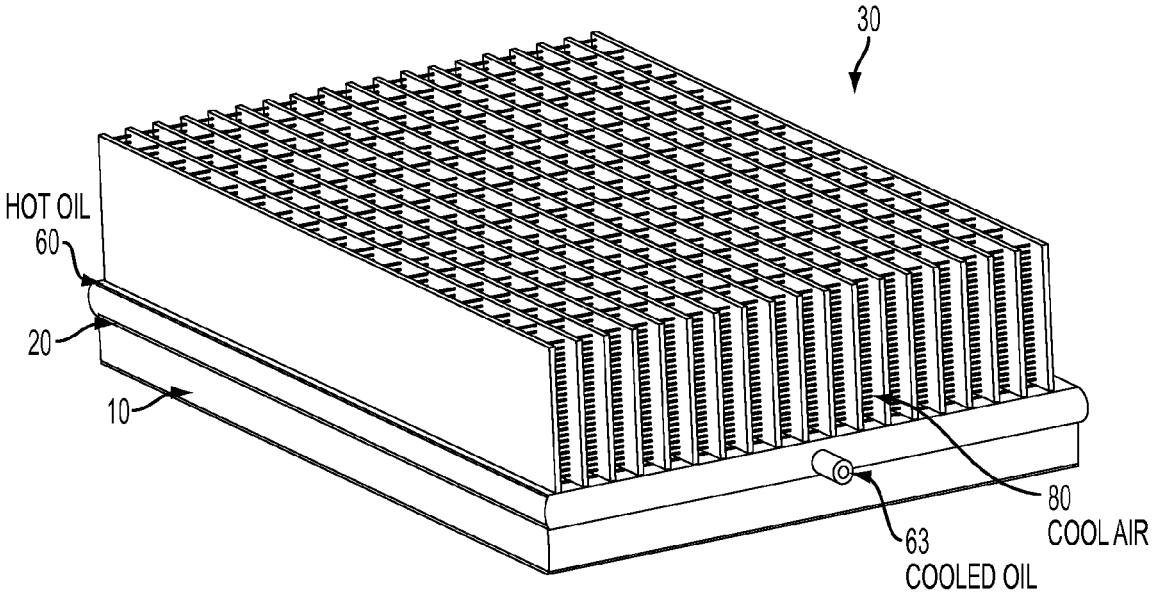
FIG. 1 is a perspective view of a surface cooler in accordance with embodiments.
Figure 2:
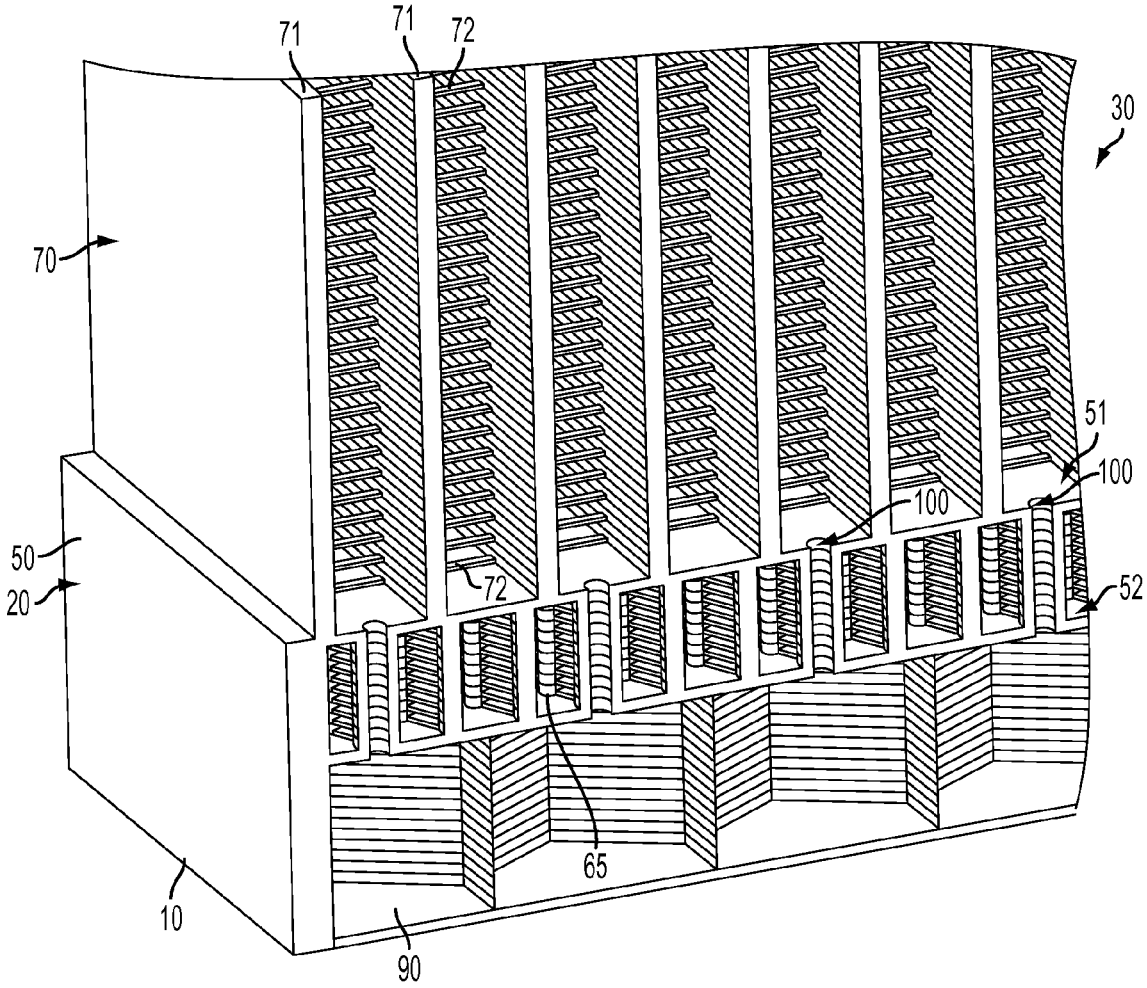
FIG. 2 is an enlarged cutaway perspective view of the surface cooler of FIG. 1.
Figure 5:
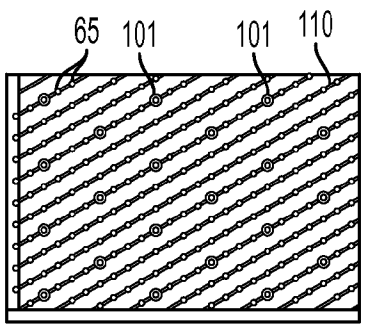
FIG. 5 is a top view of an oil layer in accordance with embodiments.

With reference to FIGS. 1, 2 and 5, an acoustic lining 10 is provided on a surface 20 of a surface cooler 30. Noise transfer tubes 101 (see FIG. 5) are defined through an oil layer 50 such that noise is permitted to travel through the oil layer 50.

As shown in FIGS. 1 and 2, the oil layer 50 is defined between first and second separating plates 51 and 52 where the first separating plate 51 is associated with a forward side of the oil layer 50 and the second separating plate 52 is associated with a rear or back side of the oil layer 50. Hot oil 60 enters the oil layer 50, flows through the oil layer 50 along any number of varying pathways and exits the oil layer 50 as cooled oil 63. Heat transfer oil pins 65 (see FIG. 5) are disposed within the oil layer 50 so as to be in contact with the first separating plate 51 and the hot oil 60.

Figure 3:
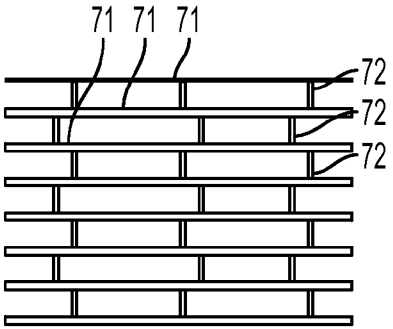
FIG. 3 is a side view of heat transfer fins in accordance with embodiments.

Fins 70 are disposed in contact with and proximate to the first separating plate 51. The fins 70 include relatively thin cooling fins 71, which are coupled to the first separating plate 51, and cross bars 72, which extend between the cooling fins 71. The cross bars 72 may be removed or their number may be significantly reduced depending on manufacturing requirements and may only be used to support the cooling fins 71 during surface cooler 30 assembly. Cool air 80 flows into the fins 70 and thereby removes heat from exposed surfaces thereof This leads to heat removal from the first separating plate 51 and the heat transfer oil pins 65 and in turn leads to heat removal from the hot oil 60 flowing through the oil layer 50. With reference to FIG. 3, the cross bars 72 may be offset relative to a flow of the cool air 80 or removed completely so as not to restrict the cool air 80 flow or limit the degree of heat removal.

Figure 6:
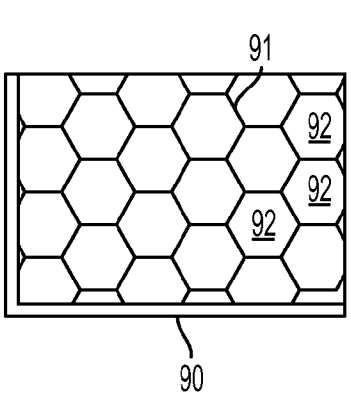
FIG. 6 is a top view of an acoustic lining layer in accordance with embodiments.
Figure 4:
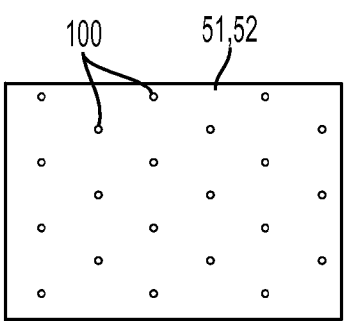
FIG. 4 is a top view of a separation plate in accordance with embodiments.

Referring back to FIG. 2 and with further reference to FIGS. 4-6, an acoustic lining layer 90 is disposed in contact with and proximate to the second separating plate 52 and is configured to employ the Helmholtz resonance effect or a similar effect to reduce noise, such as engine noise, present in or transmitted by the flow of cool air 80. The acoustic lining layer 90 may be formed with a honeycomb configuration 91, having cells 92 arrayed therein, or a similar closed-volume configuration.

As shown in FIGS. 4-6, the first and second separation plates 51 and 52 may be formed to define through-holes 100. These through-holes 100 are aligned with and fluidly communicate with the noise transfer tubes 101 which extend through the oil layer 50 such that noise can be transferred from the forward side of the oil layer 50 to the acoustic lining layer 90. The through-holes 100 of the first separating plate 51 may be positioned between the cooling fins 71 while the through-holes 100 of the second separating plate 52 may be positioned proximate to centers of corresponding cells 92. Ligaments 110, having for example a diagonal orientation, may also be disposed within the oil layer 50 to add strength and maintain the alignment of the through-holes 100 and the noise transfer tubes 101. The ligaments 110 may be oriented in any direction depending on requirements. That is, they may be oriented diagonally, in-line or in a cross-flow arrangement.

The features described above can be constructed by using laminated manufacturing techniques. For example, the laminated manufacturing techniques may include thin sheet parts (i.e., laminates), which are stacked and joined (i.e., typically brazed or diffusion bonded).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A surface cooler, comprising:

an oil layer through which oil flows;

fins extending into an air flow pathway and being disposed at a first side of the oil layer in heat transfer communication with the oil;

an acoustic lining to reduce noise present in or transmitted by the air flow pathway, which is disposed at a second side of the oil layer opposite the first side; and noise transfer tubes extending through the oil layer to transfer the noise present in or transmitted by the air flow pathway to the acoustic lining.

2. The surface cooler according to claim 1, further comprising heat transfer pins extending through the oil layer and coupled to the first separating plate.

3. The surface cooler according to claim 1, further comprising ligaments disposed to strengthen the oil layer.

4. The surface cooler according to claim 3, wherein the ligaments are oriented at least one of diagonally, in-line and in a cross-flow arrangement.

5. The surface cooler according to claim 1, wherein the fins comprise cooling fins supported by cross bars.

6. The surface cooler according to claim 5, wherein the cross bars are offset relative to a direction of air flow along the air flow pathway.

7. The surface cooler according to claim 1, wherein the acoustic lining is formed with a honeycomb configuration.

8. The surface cooler according to claim 1, wherein the acoustic lining is formed with a closed-volume configuration.

9. A surface cooler, comprising:

first and second separating plates, each of which is formed to define through-holes, the first and second separating plates each being disposed at respective first and second opposing sides of an oil layer through which oil flows;

fins extending into an air flow pathway and coupled to the first separating plate at a distance from the first separating plate through-holes;

an acoustic lining coupled to the second separating plate and being formed with a plurality of cells formed about the second separating plate through-holes; and noise transfer tubes extending through the oil layer in fluid communication with the through-holes of the first and second separating plates.

10. The surface cooler according to claim 9, wherein the first and second separating plates are substantially disposed in parallel with each other.

11. The surface cooler according to claim 9, wherein the oil flows through the oil layer from an inlet thereof at which the oil is relatively hot to an outlet thereof at which the oil is relatively cool.

12. The surface cooler according to claim 9, further comprising heat transfer pins extending through the oil layer and coupled to the first separating plate.

13. The surface cooler according to claim 9, further comprising ligaments disposed to strengthen the oil layer.

14. The surface cooler according to claim 13, wherein the ligaments are oriented at least one of diagonally, in-line and in a cross-flow arrangement.

15. The surface cooler according to claim 9, wherein the fins comprise cooling fins coupled to the first separating plate and supported by cross bars.

16. The surface cooler according to claim 15, wherein the cross bars are offset relative to a direction of air flow along the air flow pathway.

17. The surface cooler according to claim 9, wherein the first separating plate through-holes are positioned between the fins.

18. The surface cooler according to claim 9, wherein the acoustic lining is formed with a honeycomb configuration.

19. The surface cooler according to claim 9, wherein the acoustic lining is formed with a closed-volume configuration.

20. The surface cooler according to claim 9, wherein the second separating plate through-holes are positioned substantially in respective centers of each of the plurality of cells.

* * * * *